US005127807A

United States Patent [19]

Eslinger

[11] Patent Number: 5,127,807

[45] Date of Patent: Jul. 7, 1992

[54] ULTRA HIGH PRESSURE FIELD END FOR A RECIPROCATING PUMP

[75] Inventor: David M. Eslinger, Broken Arrow, Okla.

[73] Assignee: Halliburton Company, Duncan, Okla.

[21] Appl. No.: 559,021

[22] Filed: Jul. 26, 1990

[51] Int. Cl.[5] ..... F04B 11/00

[52] U.S. Cl. ..... 417/360; 403/371; 417/539; 417/540

[58] Field of Search ..... 417/540, 542, 539, 360; 403/370, 371

[56] References Cited

U.S. PATENT DOCUMENTS

| | | | |
|---|---|---|---|
| 687,864 | 12/1901 | Smyth | 403/371 X |
| 2,593,316 | 4/1952 | Kraft | 417/540 |
| 2,980,031 | 4/1961 | Russell | 417/542 |
| 2,983,281 | 5/1961 | Bynum | 137/543.23 |
| 3,191,617 | 6/1965 | Maddox | 137/516.29 |
| 3,259,075 | 7/1966 | Roth | 103/202 |
| 3,430,575 | 3/1969 | Roth | 103/153 |
| 3,597,119 | 8/1971 | Gratzmuller | 417/360 |
| 3,650,638 | 3/1972 | Cole | 417/346 |
| 3,765,449 | 10/1973 | Cole | 137/596.12 |
| 3,847,511 | 11/1974 | Cole | 417/342 |
| 4,737,084 | 4/1988 | Hammelmann | 417/539 X |
| 4,824,342 | 4/1989 | Buck | 417/539 X |
| 4,842,492 | 6/1989 | Gannaway | 417/540 X |

FOREIGN PATENT DOCUMENTS

| | | | |
|---|---|---|---|
| 714621 | 11/1931 | France | 417/540 |
| 721662 | 3/1932 | France | 417/540 |

OTHER PUBLICATIONS

Brochure No. 349 entitled "Hammelmann High-Pressure Systems-tailor made", 1987.

Paper entitled "Special Design Features Hammelmann High-Pressure Pump With Friction Free Piston Seal Assembly", publication date unknown.

Brochure entitled "Impulses Hammelmann Information", publication date unknown.

Brochure Nos. 1537D, 1537E and 1537F entitled "Hammelmann High-Pressure Systems-tailor made", published in 1984.

Brochure Nos. 948B and 948C entitled "Hammelmann High-Pressure Systems-tailor made", published in 1985.

Admac brochure entitled "Ultrahigh Pressure Waterjet Equipment", published by Admac, Inc. of Kent, Washington.

Halliburton Services Sales and Service Catalog No. 43, pp. 2414-2415, published in 1985.

*Primary Examiner*—Stephen M. Hepperle

*Attorney, Agent, or Firm*—James R. Duzan; Neal R. Kennedy

[57] ABSTRACT

An ultra high pressure fluid end for a reciprocating pump. The pump fluid end has a built-in accumulator characterized by an annular volume chamber defined in a body of the pump end. There may be a plurality of such chambers which are interconnected by a discharge manifold which is also in communication with an outlet of the body. The pump fluid end also uses frictional clamping to connect the pump plunger to the drive end of the pump. The frictional clamping includes a collet assembly comprising a split collet positioned around an end of the plunger, a collet hub disposed around the collet, and an adapter adjacent to the collet hub. Fasteners are used for clamping the collet hub to the adapter and thereby causing the collet to clampingly or grippingly engage the plunger. Coaxial inlet and outlet valves are provided in the body. A pressure retainer is disposed in the body around the plunger, and packing is used to seal between the plunger and the pressure retainer.

12 Claims, 3 Drawing Sheets

ULTRA HIGH PRESSURE FIELD END FOR A RECIPROCATING PUMP

BACKGROUND OF THE INVENTION

1. Field Of The Invention

This invention relates to the fluid ends of high pressure reciprocating pumps, and more particularly, to a pump fluid end having a built-in accumulator and which uses frictional clamping to connect the pump plunger to a push rod in the drive end of the pump.

2. Description Of The Prior Art

Hydraulic jetting, wherein fluids such as water are pumped at high pressure through jetting nozzles, is used for a variety of applications such as industrial cleaning. One industrial cleaning application in which hydraulic jetting is particularly well adapted is the cleaning of the interiors and exteriors of tubes in heat exchangers and boilers. Water jetting is also used for drilling and cutting of materials.

In hydraulic jetting, the fluids are usually pumped at ultra high pressure, for example 35,000 psi, and specialized pumping equipment is required. Typically, reciprocating plunger pumps are used. In such pumps, the drive end typically includes a crosshead to which the pump plunger is connected. Even with multiple plunger pumps, there is a problem with discharge pressure fluctuation due to the low capacity of typical water jetting systems. In an effort to minimize flow problems with such pressure fluctuations, volume chambers or accumulators are connected between the pump and the jetting system. These external accumulators solve the problem of pressure fluctuations, but do not eliminate another problem with fatigue failure of cyclically pressured components in the pump. Such fatigue problems generally occur at locations of relatively high stress concentrations, such as cyclically loaded threads. The pump of the present invention solves both the pressure fluctuation and the fatigue failure problems by providing internal volume chambers or accumulators which internally dampen fluid pressure fluctuations in the fluid end of the pump, thereby minimizing fatigue loading on pump components.

To obtain maximum plunger life in ultra high pressure pumps, the plungers are preferably made of very hard material such as carbide or ceramic. An unfortunate side effect is that such materials are brittle and more subject to failure due to impact loading. Such a problem is compounded by stress concentrations induced in attaching the plunger to the drive end of the pump such as by threaded engagement. The present invention solves this problem by providing a friction collet which clamps around the pump plunger and substantially evenly distributes the loading thereon, thus reducing induced stress concentrations and the accompanying problems.

SUMMARY OF THE INVENTION

The pump fluid end of the present invention is designed for ultra high pressures and is connected to a pump drive end of a kind known in the art. The pump fluid end comprises a body, a plunger reciprocably disposed in the body, and accumulator means within the body and in communication with an outlet thereof for internally minimizing discharge or outlet pressure fluctuations within the body as a result of reciprocation of the plunger. The accumulator means also reduces cyclic loading on components so that fatigue problems are minimized. A sealing means is provided for sealing between the plunger and the body.

In the preferred embodiment, the accumulator means is characterized by a volume chamber or accumulator defined in the body. The plunger may be one of a plurality of plungers, and the volume chamber may be one of a plurality of such chambers corresponding to the plungers. The chambers are preferably interconnected by a discharge or outlet manifold.

The pump end may also comprise an inlet or suction valve and an outlet or discharge valve disposed in the body, the valves being substantially coaxial with the plunger. The volume chamber is preferably an annular chamber disposed around the outlet valve.

The pump end may further comprise an annular sleeve disposed in the body and around the plunger, wherein the sleeve acts as a pressure retainer. The sealing means is at least partially characterized by packing disposed between the plunger and the pressure retainer.

In another preferred embodiment, the fluid end of the present invention may be said to comprise a body, a plunger disposed in the body and having an end extending therefrom, and retaining means for grippingly or clampingly engaging the end of the plunger extending from the body and connecting the plunger to a push rod in the pump drive end. The retaining means is best characterized by a collet assembly engaged with the end of the plunger.

The collet assembly comprises a split collet disposed around the end of the plunger and having a tapered outer surface, a collet hub disposed around the collet and having a tapered inner surface engaging the tapered outer surface of the collet, and means for clamping the collet hub such that the collet is grippingly engaged with the end of the plunger. The collet assembly preferably further comprises an adapter which is connectable to the pump push rod, wherein the mean for clamping is adapted for axially clamping the collet hub toward the adapter. This means for clamping may comprise fastening means, such as bolts, for fastening the collet hub to the adapter. As the collet hub is axially clamped toward the adapter, the engagement of the tapered surfaces forces the collet to grippingly engage the plunger.

It is an important object of the present invention to provide an ultra high pressure pump fluid end having internal accumulator means for minimizing pressure fluctuations at the discharge of the pump.

Another object of the invention is to provide a high pressure pump with reduced fatigue loading on the components thereof.

An additional object of the invention is to provide a means for clamping a pump plunger to the pump drive end to minimize the stress loading on the plunger, particularly when brittle materials are used for the plunger.

Additional objects and advantages of the invention will become apparent as the following detailed description of the preferred embodiment is read in conjunction with the drawings which illustrate such embodiment.

DETAILED DESCRIPTION OF THE PREFERRED EMBODIMENT

Figure 1:
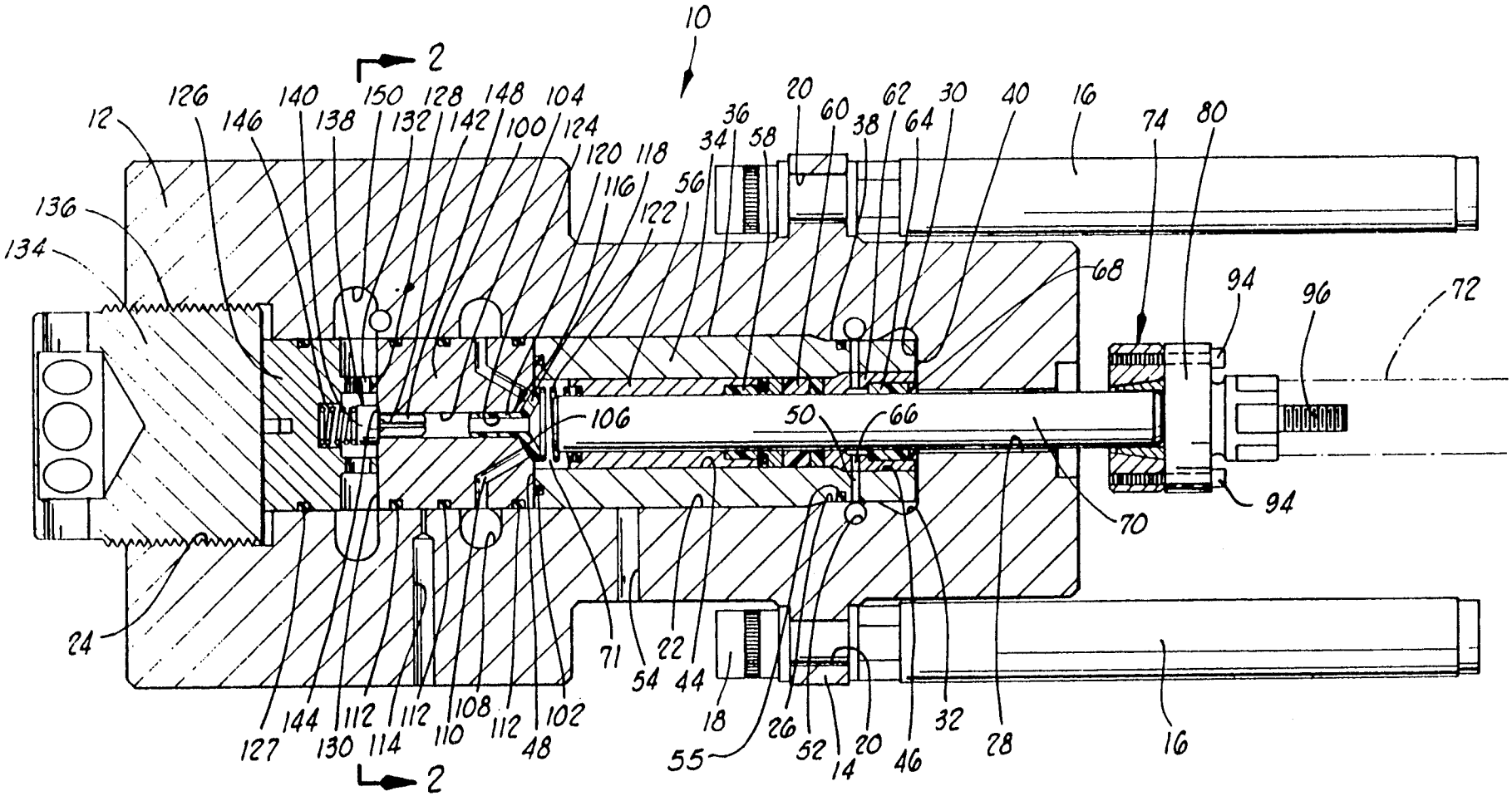
FIG. 1 is a longitudinal cross section of the ultra high pressure reciprocating pump fluid end of the present invention.

Referring now to the drawings, and more particularly to FIG. 1, the ultra high pressure fluid end of the reciprocating pump of the present invention is shown and generally designated by the numeral 10. Fluid end 10 includes a fluid end body 12 having a radially outwardly extending flange 14 thereon. A plurality of spacer tubes or rods 16 extend from flange 14 on body 12 to the drive end of the pump which includes pump push rod 72. The drive end is of a kind known in the art. One end of each spacer tube 16 is attached to body 12 adjacent to flange 14 by a fastener means such as bolt 18 extending through the corresponding hole 20 in the flange. The other end of the spacer tube is connected to the pump drive end in a conventional manner.

Figure 2:
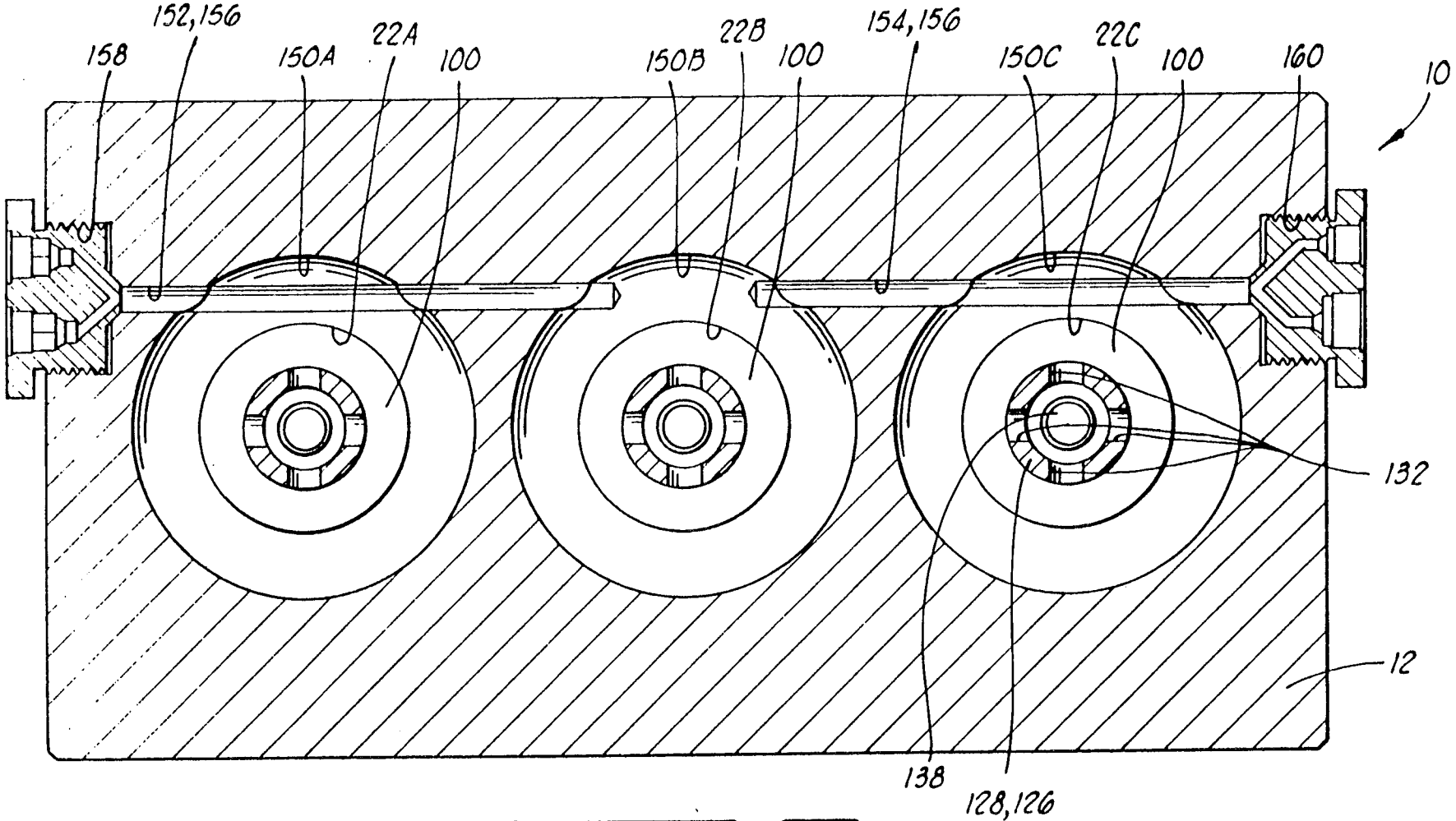
FIG. 2 is a cross section taken along lines 2—2 in FIG. 1.

Fluid end body 12 defines a plurality of substantially parallel first bores 22 therethrough. Referring now also to FIG. 2, the various first bores 22 are identified by the numerals 22A, 22B and 22C for clarity. While the embodiment shown has three first bores 22, it should be understood that the invention is not intended to be limited to this particular number. Axially outwardly of each first bore 22 is a threaded opening 24. Axially inwardly of first bore 22 is a slightly smaller second bore 26 and an even smaller third bore 28. An outwardly facing shoulder 30 extends between second bore 26 and third bore 28, and there is an annular relief 32 adjacent to shoulder 30.

Disposed in each first bore 22 of fluid end body 12 is a pressure retainer or sleeve 34 having a first outside diameter 36 which fits within first bore 22 and a smaller, second outside diameter 38 which extends into second bore 26. An inner end 40 of pressure retainer 34 is positioned adjacent to shoulder 30.

Pressure retainer 34 defines a first bore 44 therein with a slightly larger second bore 46 at the axially inner end thereof. Pressure retainer 34 has an outer end 48 opposite inner end 4 thereof.

Extending transversely through pressure retainer 34, and intersecting second bore 46 thereof, is at least one port 50 which is in communication with lubrication ports 52 in body 12 which intersect second bore 26 in the body.

Body 12 defines a plurality of transversely extending ports 54, each of which intersects one of first bores 22A, 22B or 22C in body 12. It will be seen that the radially inner end of port 54 is adjacent to first outside diameter 36 of pressure retainer 34.

A sealing means, such as an O-ring 55, provides sealing engagement between pressure retainer 34 and second bore 26 in body 12. It will be seen that lubrication ports 52 and ports 54 are thus sealingly separated.

Disposed in pressure retainer 34 is a volume reducer 56 which has a first plunger bearing 58 positioned in the axially inner end thereof.

A sealing means, such as packing assembly 60, is disposed in first bore 44 of pressure retainer 34 adjacent to the inner end of volume reducer 56. Packing assembly 60 is of a kind known in the art and is supported and held in place by a packing carrier 62. A second plunger bearing 64 is disposed in packing carrier 62. First and second plunger bearings 58 and 64 are substantially identical. Packing carrier 62 also defines at least one radially extending hole 66 therethrough which is in communication with port 50 in pressure retainer 34. A sealing means, such as seal 68, provides sealing on the side of second plunger bearing 64 opposite hole 62.

An elongated pump plunger 70 extends into a pumping chamber 71 defined within pressure retainer 34 and volume reducer 56 and also extends through third bore 28 in fluid end body 12. It will be seen by those skilled in the art that plunger 70 is supported and guided by the bearing means of first and second plunger bearings 58 and 64 and sealing engagement is provided on the plunger by packing assembly 60.

Figure 3:
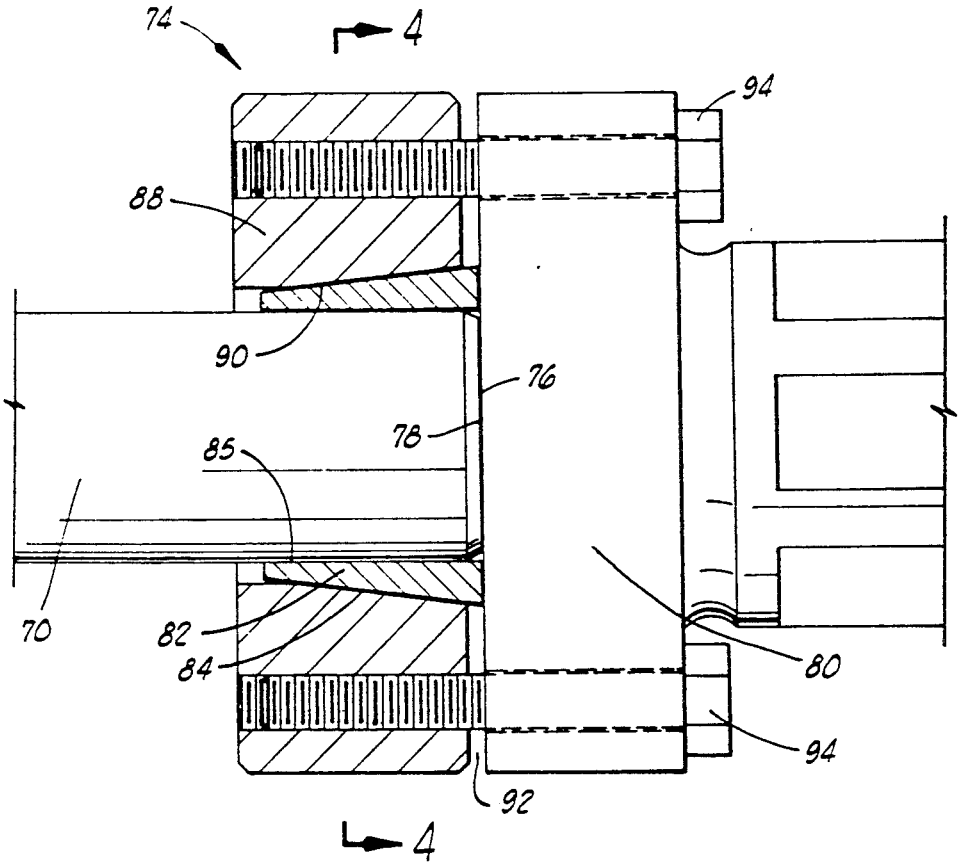
FIG. 3 is an enlarged cross section of a friction collet used to hold a plunger in the pump.
Figure 4:
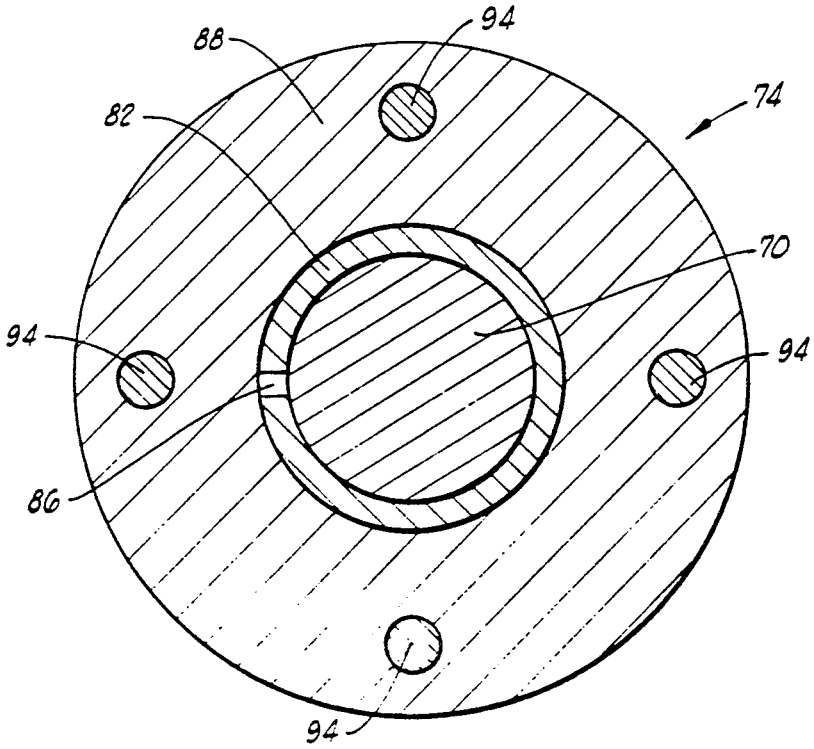
FIG. 4 is a cross section taken along lines 4—4 in FIG. 3.

Plunger 70 is connected to pump push rod 72 by a retaining or clamping means generally designated by the numeral 74. As previously noted, pump push rod 72 is part of the drive end of the pump and is of a kind known in the art. Referring now to FIG. 3, the details of clamping means 74 are shown.

An axially inner end 76 of plunger 70 abuts a face 78 of a push rod adapter 80. Disposed around end 76 of plunger 70 and adjacent to face 78 is a collet 82 having a tapered outer surface 84 and a bore 85 therethrough. Collet 82 also has a substantially transverse split or gap 86 defined therethrough.

Disposed around collet 82 is a collet hub 88 having a tapered inner surface 90 adapted for engagement with tapered outer surface 84 of the collet. Tapered surfaces 90 and 84 are sized such that a gap 92 remains between collet hub 88 and face 78 of push rod adapter 80. Collet hub 88 is attached to push rod adapter 80 by a fastener means, such as a plurality of bolts 94. It will be seen by those skilled in the art that, as bolts 94 are tightened, collet hub 88 will be drawn axially closer to push rod adapter 80. Because of gap 86 and the engagement of tapered surface 90 in collet hub 88 with tapered surface 84 on collet 82, a substantially evenly distributed clamping force will be applied on the end of plunger 70 by bore 85 in collet 82.

Plunger 70 works best if it is made of a hard material, such as tungsten carbide or ceramic, but such materials are generally brittle. The even clamping force applied by collet 82 on the end of plunger 70 reduces the likelihood of failure of plunger 70 compared with other fastening techniques such as directly threading the plunger to push rod 72.

Referring again to FIG. 1, push rod adapter 80 has connecting means, such as a threaded portion 96, for connecting to push rod 72 in a manner known in the art.

A valve guide 100 is disposed in first bore 22 of fluid end body 12 adjacent to outer end 48 of pressure retainer 34. A sealing means, such as O-ring 102, provides sealing engagement between valve guide 100 and pressure retainer 34.

Valve guide 100 defines a central bore 104 therethrough with a tapered surface or seat 106 at the axially inner end thereof. It will be seen that seat 106 and bore 104 are in communication with first bore 44 in pressure retainer 34.

Fluid end body 12 defines an inlet flow passage 108, also referred to as inlet 108, adjacent to valve guide 100. Valve guide 100 defines a plurality of angled ports 110 which provide communication between seat 106 and inlet 108. A sealing means, such as O-rings 112, provide sealing engagement between valve guide 100 and first bore 22 in body 12 on opposite sides of inlet 108.

A plurality of vent ports 114 are provided transversely through body 12 and each intersects a corresponding first bore 22. Another O-ring 112 may be disposed on the axially outer side of each vent 114.

Thus, a pair of O-rings 112 provides a sealing means for sealing engagement between valve guide 100 and body 12 on opposite sides of vent 114.

An inlet or suction valve 116 is disposed in valve guide 100 and has a sealing portion 118 adapted for sealing engagement with seat 106 in valve guide 100, and further has a guide portion 120 which extends into bore 104 in valve guide 100. An inlet valve spring 122 is positioned between sealing portion 118 of inlet valve 116 and the radially outer end of volume reducer 56. Spring 122 acts as a biasing means for biasing inlet valve 116 toward its closed position which is illustrated in FIG. 1.

Inlet valve 116 defines an axially extending central opening 124 therethrough which, as will be seen by those skilled in the art, is in communication with bore 104 in valve guide 100 and is also in communication with pumping chamber 71.

A valve cover 126 is disposed in first bore 22 of fluid end body 12 axially outwardly of valve guide 100. A sealing means, such as an O-ring 127, provides sealing engagement between valve cover 126 and first bore 22.

Valve cover 126 has a cylindrical portion 128 which abuts axially outer end 130 of valve guide 100. A plurality of transverse ports 132 are defined through cylindrical portion 128 of valve cover 126 as seen in FIGS. 1 and 2.

Cover retainer 134 has an externally threaded surface 136 which is engaged with threaded opening 24 in fluid valve body 12. It will be seen by those skilled in the art that valve cover 126, valve guide 100 and pressure retainer 34 are held in the operating positions thereof shown in FIG. 1 by tightening cover retainer 134.

An outlet or discharge valve 138 is positioned within valve cover 126 and valve guide 100. Outlet valve 138 has a sealing portion 140 generally disposed within cylindrical portion 128 of valve cover 126 and a guide portion 142 extending into bore 104 in valve guide 100. Outer end 130 of valve guide 100 has an annular seat portion 144 against which sealing portion 140 of outlet valve 138 seats when the outlet valve is closed. An outlet valve spring 146 is positioned between valve cover 126 and sealing portion 140 of outlet valve 138, thus providing a biasing means for biasing outlet valve 138 toward its closed position shown in FIG. 1. Guide portion 142 of outlet valve 138 has a plurality of axially extending grooves 148 therealong which allow fluid flow through guide portion 142 when outlet valve 138 is in an open position, as will be further discussed herein.

Along first bore 22, fluid end body 12 defines an annular volume chamber or accumulator 150. As best seen in FIG. 2, there is an accumulator 150, designated by the numerals 150A, 150B and 150C, corresponding to each of bores 22A, 22B and 22C. A first transverse port 152 extends between accumulators 150A and 150B, and a second transverse port 154 interconnects accumulators 150B and 150C. Ports 152 and 156 may be referred to collectively as outlet or discharge manifold 156, and it will be seen that outlet manifold 156 insures that all of accumulators 150 are in communication with one another.

OPERATION OF THE INVENTION

Lubrication is provided to packing assembly 20 through port 52 in fluid end body 12 and ports 50 and 66. As already indicated, plunger 70 is supported on, and guided by, first and second plunger bearings 58 and 64.

As plunger 70 is moved towards bottom dead center during an operating cycle (to the right in FIG. 1), the pressure in pumping chamber 71 in pressure retainer 34 and volume reducer 56 is below the fluid inlet pressure at inlet port 108. It will be seen by those skilled in the art that inlet valve 116 will be moved away from seat 106 by the pressure differential across the inlet valve, compressing spring 122 and exposing inlet ports 10. Fluid will enter pumping chamber 71 through inlet ports 10 and past inlet valve 116.

As plunger 70 is moved back towards its top dead center position (to the left in FIG. 1), the plunger recloses inlet valve 116 and forces fluid through central opening 124 in the inlet valve. Outlet valve 138 is then forced away from seat 144 so that the fluid is discharged through bore 104 in valve guide 100 and grooves 148 in the outlet valve into the corresponding accumulator 150, which as previously indicated is in communication with the other accumulators 150.

As the operating cycle is repeated, discharge valve 138 is closed as plunger 70 again moves toward the bottom dead center position.

All of interconnected accumulators 150 provide a volume which significantly increases system capacitance, thereby greatly reducing the amplitude of the discharge pressure fluctuations. This reduces the cyclic loading on cover retainer 134 and threaded surfaces 24 and 136. Thus, fatigue failure problems are minimized.

Further, since the accumulators are internal in fluid end body 12, high pressure connections are not needed as is the case with external accumulators. The elimination of such connections eliminates a potential leak path.

Each port 54 in fluid end body 12 acts as a vent to prevent pressure from building up around the corresponding pressure retainer 34. In other words, pressure on the outsides of pressure retainers 34 is essentially atmospheric, and all of the pumping pressure is contained within pressure retainers 34 and not radially applied to fluid end body 12. Ports 54 also act as drains to prevent the accumulation of any fluids around pressure retainers 34.

Each vent 114 in fluid end body 12 prevents any communication between inlet 108 and accumulators 150, so that there is no leakage between the inlet and outlet.

It will be seen that the ultra high pressure fluid end for a reciprocating pump of the present invention is well adapted to carry out the ends and advantages mentioned, as well as those inherent therein. While a presently referred embodiment of the apparatus has been shown for the purposes of this disclosure, numerous changes in the arrangement and construction of parts may be made by those skilled in the art. All such changes are encompassed within the scope and spirit of the appended claims.

What is claimed is:

1. A pump fluid end comprising:

a body having an inlet and an outlet;

a plunger reciprocably disposed in said body;

a pressure retainer disposed in said body and around said plunger;

sealing means for sealing between said plunger and said body, said sealing means being at least partially characterized by packing disposed between said plunger and said pressure retainer; and accumulator means within said body and in communication with said outlet for internally minimizing discharge pressure fluctuations within the body as a result of reciprocation of said plunger, said accumulator means being characterized by an annular chamber defined in said body.

2. The fluid end of claim 1 further comprising an outlet valve disposed in said body, wherein said annular chamber defined in said body is disposed around said outlet valve.

3. The fluid end of claim 1 wherein:

said plunger is one of a plurality of parallel plungers; and said annular chamber is one of a plurality of adjacent annular chambers corresponding to said plungers, said annular chambers being interconnected so that there is fluid communication therebetween.

4. The pump end of claim 1 further comprising:

an inlet valve disposed in said body and substantially coaxial with said plunger; and an outlet valve disposed within said body and substantially coaxial with said plunger.

5. A pump fluid end comprising:

a body having an inlet and an outlet;

a plurality of parallel plungers reciprocably disposed in said body wherein:

said plungers and said body define a plurality of pumping chambers within said body; and said body defines a plurality of accumulators within said body and adjacent to corresponding ones of said pumping chambers; and a collet assembly for grippingly engaging an end of each of said plungers extending from said body and adapted for connection to a pump drive end and minimizing stress loading on said ends of said plungers.

6. The fluid end of claim 5 wherein said accumulators are interconnected and in communication with said outlet of said body.

7. The pump of claim 5 further comprising:

an inlet valve disposed between each of said pumping chambers and said inlet of said body; and an outlet valve disposed between each of said pumping chambers and the corresponding accumulator.

8. The pump end of claim 5 wherein said collet assembly comprises:

a collet disposed around said end of said plunger, said collet having a split therein and a tapered outer surface;

a collet hub disposed around said collet and having a tapered inner surface for engaging said tapered outer surface of said collet;

an adapter adjacent to said collet hub and defining a gap therebetween, said adapter having means for connecting to a push rod of said pump drive end; and fastening means for attaching said collet hub and adapter and axially clamping said collet hub toward said adapter such that said collet is grippingly engaged with said end of said plunger.

9. A pump fluid end comprising:

a body having an inlet and an outlet;

a plunger reciprocably disposed in said body;

sealing means for sealing between said plunger and said body;

accumulator means within said body and in communication with said outlet for internally minimizing discharge pressure fluctuations within the body as a result of reciprocation of said plunger, said accumulator means being characterized by an annular chamber defined in said body; and a collect assembly for connecting said plunger to a pump drive end, said collet assembly comprising:

a split collet disposed around an end of said plunger;

a collet hub disposed around said collet;

an adapter adjacent to said collet hub and adapted for connection to said pump drive end; and fastening means for attaching said collet hub to said adapter and thereby clampingly engaging said collet with said plunger such that stress loading on said plunger is minimized.

10. The fluid end of claim 9 further comprising an outlet valve disposed in said body, whereby said chamber is an annular chamber disposed around said outlet valve.

11. The fluid end of claim 10 wherein:

said plunger is one of a plurality of plungers; and said chamber is one of a plurality of chambers corresponding to said plungers, said chambers being interconnected.

12. The pump end of claim 9 further comprising:

an inlet valve disposed in said body and substantially coaxial with said plunger; and an outlet valve disposed within said body and substantially coaxial with said plunger.

* * * * *